US006314768B2

(12) United States Patent
Motoya

(10) Patent No.: US 6,314,768 B2
(45) Date of Patent: Nov. 13, 2001

(54) LACE KNIT AND ITS KNITTING METHOD

(75) Inventor: Yasuhiko Motoya, Takarazuka (JP)

(73) Assignee: Sakae Lace Co. Ltd. (JP)

( * ) Notice: Subject to any disclaimer, the term of this patent is extended or adjusted under 35 U.S.C. 154(b) by 0 days.

(21) Appl. No.: 09/728,559

(22) Filed: Dec. 1, 2000

(30) Foreign Application Priority Data

Dec. 2, 1999 (JP) ..... 11-343206

(51) Int. Cl.[7] ..... D04B 21/06
(52) U.S. Cl. ..... 66/85 R; 66/195
(58) Field of Search ..... 66/180, 192, 193, 66/195, 84 R, 85 R, 203, 169 R, 172 R, 172 E, 190, 84 A; 442/306, 312, 314

(56) References Cited

U.S. PATENT DOCUMENTS 3,590,603 * 7/1971 Jackson ..... 66/147
3,673,820 * 7/1972 Sarmiento ..... 66/177
3,866,444 * 2/1975 Levin ..... 66/195
4,074,543 * 2/1978 Schmidt ..... 66/193
4,748,078 * 5/1988 Doi et al. ..... 442/312
5,265,445 * 11/1993 Shytles et al. ..... 66/192
5,797,283 * 8/1998 Kaczmarczyk ..... 66/193

* cited by examiner

*Primary Examiner*—Danny Worrell
(74) *Attorney, Agent, or Firm*—Webb Ziesenheim Logsdon Orkin & Hanson, P.C.

(57) ABSTRACT

A lace knit includes a plurality of wales formed in a vertical direction of the lace knit by chain-stitched warp yarns; a plurality of courses formed continuously by needle loops of the warp yarns disposed in a lateral direction of the lace knit; and a plurality of sinker loops formed in the needle loops of the wales so as to form a ground weave in the form of a net allowing insertion of insertion yarns such as weft yarns and/or pattern-forming yarns therein. The ground weave includes a basic-gauge portion knitted under a basic gauge and an extended-gauge portion knitted under an extended-gauge sparser than the basic gauge. A method of knitting such lace knit is also disclosed.

15 Claims, 9 Drawing Sheets

LACE KNIT AND ITS KNITTING METHOD

BACKGROUND OF THE INVENTION

1. Field of the Invention

The present invention relates generally to a lace knit and its knitting method. More particularly, the invention relates to a lace knit comprising: a plurality of wales formed in a vertical direction of the lace knit by chain-stitched warp yarns; a plurality of courses formed continuously by needle loops of the warp yarns disposed in a lateral direction of the lace knit; and a plurality of sinker loops formed in the needle loops of the wales so as to form a ground weave in the form of a net allowing insertion of a plurality of insertion yarns such as weft yarns and/or pattern-forming yarns therein. The invention also relates to a method of knitting such lace knit comprising the step of chain-stitching a plurality of warp yarns so as to form, with a plurality of operational cycles of a lace knitting machine, a ground weave including a plurality of wales formed in a vertical direction of the lace knit by chain-stitched warp yarns, a plurality of courses formed continuously by needle loops of the warp yarns disposed in a lateral direction of the lace knit, and a plurality of sinker loops formed in the needle loops of the wales.

2. Description of the Related Art

A conventional lace knit of the above type is shown in FIG. 8. In this, a plurality of wales 1 are formed side by side of chain-stitched warp yarns 4 in a vertical direction of the knit, and a plurality of courses 2 are formed continuously in a lateral direction of the knit by needle loops of the warp yarns 4 disposed side by side, and also a plurality of sinker loops 12 are formed in the needle loops 11 of the wales 1 for allowing insertion of a plurality of weft yarns 7 therein, so as to together form a ground weave in the form of a net including the plurality of wales 1 interconnected with each other. To this ground weave, there are further interwoven a plurality of pattern-forming yarns 9 for forming an ornamental lace pattern so as to complete a lace knit 10.

The above-described ground weave of this lace knit 10, as shown in FIG. 9, typically comprises a net in which the wales 1 and the weft yarns are knitted with a uniform gauge over the entire width of the lace knit (e.g. 24 gauge; the needle bed includes 24 needles per inch (25.4 mm) and the yarn guide block also includes 24 guides per inch (25.4 mm)). FIG. 9 is a weave knitting diagram showing the weft yarns also. More particularly, as shown in FIG. 10, a lace knitting machine for use in knitting the illustrated lace typically comprises a raschel knitting machine including a knitting section 24 having a needle bed and a plurality of guide blocks, a take-up roll 25 for taking up the lace knit 10 knitted by the knitting section 24, a ground beam 21 for feeding ground yarns 3 (including both warp yarns 4 and weft yarns 7) to the knitting section 24, an elastic-yarn beam 22 for feeding an elastic yarn 6 and a plurality of pattern-forming yarn beams 23 for feeding a plurality of insertion yarns 5 such as pattern-forming yarns. In this application, as will become apparent from the following detailed description, what is referred to as "insertion yarns" means any of non-warp yarns to be inserted across the wales 1. More particularly, the term "insertion yarns" employed herein refers to any other such non-warp yarns as weft yarns 7, pattern-forming yarns 9, and so on.

Typical usage and arrangement of the guide blocks in the knitting section 24 are shown in FIG. 11. The ground beam 21 feeds the warp yarns 4 and the weft yarns 7 as the ground yarns 3. For knitting the respective yarns in the lace knit 10, there is provided a group 30 of ground-yarn guide blocks which include, in the order from the front side of the machine (the light-hand in FIG. 10 or left-hand in FIG. 11) a warp guide block 31 for guiding the warp yarn 4 for forming the wale 1 and weft guide blocks 33 consisting of an ordinary weft guide block and a special guide block capable of adjusting traverse movement of the weft yarn 7. Thus, the warp guide block 31 and the weft guide block 33 together constitute the ground yarn guide block group 30. And, behind this ground yarn guide block group 30, there are arranged, one after another, a plurality of pattern-forming yarn guide blocks 29 for the pattern-forming yarns 9. Then, at the last position, there is disposed an elastic-yarn guide block 32 for guiding the elastic yarn 6 into the wale 1.

With the lace knit 10 knitted according to the above arrangement, the elastic yarns 6 are located on one side of the ground weave and at the lowermost portion of the knit. An example of such lace knit product knitted in the above-described manner is shown in FIG. 12. As shown, in this knit, both pattern-forming portions 17 and a net portion 13 are provided as basic-gauge, densely knitted weave portions 14, and the pattern-forming yarns 9 used therein are thin, thus the ornamental lace pattern formed thereby lacks depth or swelling from the ground weave.

In the case of knitting scheme according to a uniform gauge as described above, it may be still possible to employ thick yarns as some of the pattern-forming yarns 9. However, it is difficult to form a thick lace knit similar to as the so-called leaver lace, since the ground weave and the pattern-forming yarns consist of the yarns of uniform thickness along the entire width thereof. For instance, for knitting a raschel lace knit knitted under 24 gauge, typically, pattern-forming yarns of about 78–133 tex (700–1200 denier) are employed. Then, if it is desired to employ, instead, thicker yarns of about 145–178 tex (1300–1600 denier) in order to achieve a thicker pattern. This will be extremely difficult due to such restrictions as the inter-needle spacing in the needle bed, the inter-guide spacing of the yarn guides, the feasible traversing amount of the guides, etc. In particular, when a conventional raschel knitting machine is employed, as its weft guide blocks 33 are operated by a single traverse mechanism, it is impossible to vary the traversing amount of the weft yarn 7 in the width direction (the lateral direction in FIG. 12) of the lace knit 10 for providing different traversing amounts in individual width-wise segments of the lace. With lace knit products in general, it is commonly believed that the more densely and three-dimensionally knitted, the more desirable and of better quality. Then, in the case of the above-described conventional construction, even if some of the warp yarns 4 are set to the warp yarn guide block 31 with twice larger gauge spacing than the others, such desirable lace knit product cannot be produced.

Then, in order to provide a lace knit having a desirable thickness or depth at desired portions thereof by inserting thick yarns therein, the present inventors conducted extensive and intensive research and development to achieve this object, considering also the possibility of partial modification of the existing raschel knitting machine for this purpose. As a result, the present inventors have succeeded in inserting insertion yarns having twice greater thickness than the yarns forming the basic-gauge weave, thus producing such lace knit having desirable increased thickness at a portion thereof (e.g., insertion of a thick yarn of 145–178 tex (1300–1600 denier in a lace knit knitted with both 24 gauge and 12 gauge).

Therefore, the primary object of the present invention is to provide a lace knit having massive or voluminous texture and a method of manufacturing such lace knit by making it possible to provide desirable increased thickness at a portion of the lace, cause the ornamental pattern thereof to rise proud from the ground weave of the lace and also to insert a thick yarn therein.

SUMMARY OF THE INVENTION

For accomplishing the above-noted object, according to the general concept of the present invention, in a lace knit comprising a plurality of wales formed in a vertical direction of the lace knit by chain-stitched warp yarns; a plurality of courses formed continuously by needle loops of the warp yarns disposed in a lateral direction of the lace knit; and a plurality of sinker loops formed in the needle loops of the wales so as to form a ground weave in the form of a net allowing insertion of insertion yarns such as weft yarns and/or pattern-forming yarns therein, the ground weave includes a densely-knitted weave portion where an inter-wale distance between the adjacent wales is small and a sparsely-knitted weave portion where the inter-wale distance is large. More particularly, the invention provides the following features.

According to one aspect of the present invention, there is provided a lace knit having the following features.

According to a first feature of the present invention, the ground weave includes a basic-gauge portion knitted under a basic gauge and an extended-gauge portion knitted under an extended gauge sparser than the basic gauge.

With the knit lace of the invention having the above feature, the ground weave includes a relatively dense basic-gauge portion and a relatively sparse extended-gauge portion, so that the extended-gauge portion is capable of providing the weave with looseness, which in turn allows smooth insertion of thick insertion yarns therein. As a result, this extended-gauge portion provides variation in the thickness of the yarns to be inserted therein. Then, by increasing the amount of the insertion yarns, that is, the weft yarns and/or pattern-forming yarns to be inserted therein, the voluminousness of this portion may be increased in contrast to or relative to the basic-gauge portion.

More particularly, the sparsely knitted extended-gauge portion is easier to provide looseness in the insertion yarns compared with the densely knitted basic-gauge portion, so that the insertion yarns such as the weft yarns or the pattern-forming yarns will positively 'float' in this area. Moreover, the greater looseness allows use of thick yarns as the insertion yarns. Consequently, the basic-gauge portion and the extended-gauge portion provide areas of different thickness in the lace knit and also massive texture thereto.

According to a second feature of the present invention, in the construction having the first feature, the basic-gauge portion at least partially includes ornamental holes.

With this feature, in addition to the function and effects described above in connection with the first feature, the lace knit has the ornamental patterns both in the extended-gauge portion and the basic-gauge portion at the latter's predetermined portions, thus enhancing the cosmetic value of the product.

According to a third feature of the present invention, in the construction having the first or second feature, the extended-gauge portion includes, as the insertion yarns, a group of extended-gauge weft yarns knitted under the extended gauge, and some of these extended-gauge weft yarns are inter-knitted in the basic-gauge portion at certain predetermined courses.

With this third feature, in addition to the function and effect of the first or second feature, the lace knit includes, in certain predetermined courses of the basic-gauge portion, increased thickness which may be provided with a texture pattern having massive texture for providing variation in the visual impression in the overall knit lace.

According to a fourth feature of the present invention or, in the construction having the second or third feature, the extended-gauge portion is formed as a pattern-forming portion having pattern-forming yarns therein.

With this fourth feature, in addition to the function and effect of the second or third feature described above, by forming an ornamental pattern in the extended-gauge portion with the increased thickness, the ornamental pattern may be effectively highlighted for better visual impression.

According to a fifth feature of the present invention, in the construction having the first or second feature, at least some of the insertion yarns to be knitted in the extended-gauge portion are thicker than basic insertion yarns which are knitted mainly in the basic-gauge portion.

With this fifth feature, in addition to the respective function and effect of the first or second feature described above, by using, as some of the pattern-forming yarns, thick yarns, which are thicker than the other pattern-forming yarns, these thick yarns may be made visually prominent, thereby to form a design-wise superior pattern in the lace.

According to another aspect of the present invention, there is provided a method of knitting such lace knit comprising the step of chain-stitching a plurality of warp yarns so as to form, with a plurality of operational cycles of a lace knitting machine, a ground weave including a plurality of wales formed in a vertical direction of the lace knit by chain-stitched warp yarns, a plurality of courses formed continuously by needle loops of the warp yarns disposed in a lateral direction of the lace knit, and a plurality of sinker loops formed in the needle loops of the wales. The method comprises the steps of: providing the knitting machine with a needle bed which includes a basic-gauge needle bed section having needles thereof arranged according to a basic gauge and an extended-gauge needle bed section having needles thereof arranged according to an extended-gauge sparser than the basic gauge; correspondingly providing the knitting machine at least one basic-gauge guide block having guides thereof arranged according to the basic gauge and at least one extended-gauge guide block having guides thereof arranged according to the extended gauge or set to the extended gauge by setting yarns thereon according to the extended-gauge; and knitting the yarns with the knitting machine so that the lace knit in which the inter-wale distance between adjacent wales of the knit of a certain area of the knit differs from that of another area of the same. In this aspect, the invention specifically provides the following features.

According to a first feature of the knitting method, of the present invention, in forming the ground weave, the method comprises the steps of:

providing the knitting machine with a needle bed which includes a basic-gauge needle bed section having needles thereof arranged according to a basic gauge and an extended-gauge needle bed section having needles thereof arranged according to an extended-gauge sparser than the basic gauge, with the basic-gauge needle bed section and the extended-gauge needle bed section being arranged adjacent each other; and correspondingly providing the knitting machine at least one basic-gauge guide block having guides thereof arranged according to the basic gauge and at least one extended-gauge guide block having guides thereof arranged according to the extended gauge or set to the extended gauge by setting yarns thereon according to the extended-gauge; and knitting a basic-gauge portion and an extended-gauge portion in series with using both the basic-gauge needle bed section and the extended-gauge needle bed section in combination as the needle bed and using both the basic-gauge guide block and the extended-gauge guide block in combination as the yarn guide.

With the knitting method of the invention described above, by providing the needle bed with the basic-gauge needle bed section and the extended-gauge needle bed section in a mixed state, it is possible to provide variation in the inter-wale distance in the width direction of knitting. Also, by correspondingly providing the guide blocks with the basic-gauge and extended-gauge guide block groups, it is possible to provide the ground weave with a densely knitted area and a sparsely knitted area for providing density variation in the width direction of the knitted lace. Further, the greater inter-wale distance in the sparsely knitted area allows for thick yarns inserted therein to float proud in contrast to the other area. Overall, the entire lace knit may comprise combination of a thin lace and a thick lace inter-knitted with each other. Moreover, other unique function and effect as follows are provided.

Namely, with the knitting method having the first feature described above, in the knitting operation, the inter-wale distance of the wales formed by the extended-gauge needle bed section is made greater than the inter-wale distance of the wales formed by the basic-gauge needle bed section. Hence, when insertion yarns such as weft yarns are knitted, in the wales formed by the yarns of the extended-gauge needle bed section, its inter-wale distance between the adjacent wales is varied more prominently than that of the wales formed by the yarns of the basic-gauge needle bed section, so as to cause greater looseness or resultant floating of further insertion yarns such as pattern-forming yarns knitted into the extended-gauge portion having this greater wale-distance. As a result, the completed lace knit provides apparently greater thickness in the extended-gauge portion than the basic-gauge portion.

According to a second feature of the knitting method of the present invention, wherein in forming the ground weave, weft yarns are inserted into the respective sinker loops formed in the needle loops of the wales;

a plurality of the basic-gauge guide blocks and a plurality of said extended-gauge guide blocks are provided;

in forming the basic-gauge portion, at least one of the basic-gauge guide blocks is employed as a basic-gauge warp guide block, at least another of the basic-gauge guide blocks is employed as a basic-gauge weft guide block; and in forming the extended-gauge portion, at least another of the basic-gauge guide blocks or at least one of the extended-gauge guide blocks is employed as an extended-gauge warp guide block while at least another of the extended-gauge guide blocks is employed as an extended-gauge weft guide block.

The usage of the guide blocks provided by the second feature above is novel per se. With this usage, the target lace knit including the basic-gauge portion and the extended-gauge portion may be knitted easily.

According to a third feature of the knitting method of the present invention, at least some of the yarns set on the guides of the extended-gauge weft guide block are inter-knitted in the basic-gauge portion at certain predetermined courses.

With the method having the third feature described above, in addition to the function and effect of the first or second feature of the method, the weft yarns from the extended-gauge guide block are inter-knitted into the basic-gauge portion, so that sinker loops extending across a plurality of wales are formed within the basic-gauge portion for providing increased thickness in the ground weave and texture pattern. That is, in the basic-gauge portion, in addition to the weft yarns inserted into the ground weave under the basic gauge, further weft yarns with a traversing amount under the extended gauge will be overlaid. As a result, the ground weave formed by the further weft yarns fed from the extended-gauge weft guide blocks will be shifted toward the basic-gauge portion and formed at different lateral positions of the lace knit. Therefore, in knitting a lace knit having uneven lateral edges, by traversing the extended-gauge weft guide blocks according to the lateral edges, there will be obtained a lace knit having voluminous ornamental pattern extending to the lateral edges.

According to a fourth feature of the knitting method of the invention, in the method having the second or third feature described above, the extended-gauge portion is knitted by traversing, in certain predetermined courses, the extended-gauge guide blocks by a greater traversing amount than a basic traversing amount for knitting the basic-gauge portion.

With the method having the fourth feature above, in addition to the function and effect of the second or third feature, by traversing the extended-gauge guide blocks by an amount (e.g. two or more traversing gauges under the extended-gauge) greater than the basic traversing amount (e.g. one gauge traversing under the extended gauge), the sinker loops formed by the insertion yarns from the extended-gauge guide blocks will be inserted not only into the adjacent wales but also across a plurality of wales. With this, the length of the sinker loops formed in each course by the weft yarns from the extended-gauge guide blocks is significantly increased, whereby the total amount of the knitted weft yarns will be increased. As a result, due to the tension applied to these weft yarns from the extended-gauge guide blocks, the ground weave will be pulled laterally, so that the ground weave inserted with the weft yarns from the extended-gauge guide blocks will be contracted to some extent in the lateral direction.

According to a fifth feature of the knitting method of the present invention, in knitting the insertion yarns into the extended-gauge portion, some of the insertion yarns will be applied with a knitting tension greater than a knitting tension applied to the others.

With the above, since the extended-gauge portion is knitted according to the sparser or extended gauge and some of the insertion yarns to be inserted therein are subjected to a greater tension than a tension applied to the others, the yarns knitted with the greater tension contribute to increase of the density of the network of the ground weave. Consequently, the other insertion yarns knitted with smaller tension will be formed to project more conspicuously in the thickness direction of the lace knit.

Further and other features and advantages of the invention will become apparent from the following detailed description of the preferred embodiments of the invention with reference to accompanying drawings.

DESCRIPTION OF THE PREFERRED EMBODIMENTS

Next, preferred embodiments of a lace knit and its knitting method both relating to the present invention will be described with reference to the accompanying drawings. In the following discussion, elements identical to those employed in the convention and shown in FIGS. 8–12 will be denoted with the same numerals and some of their discussion will be omitted to avoid redundancy.

Figure 1:
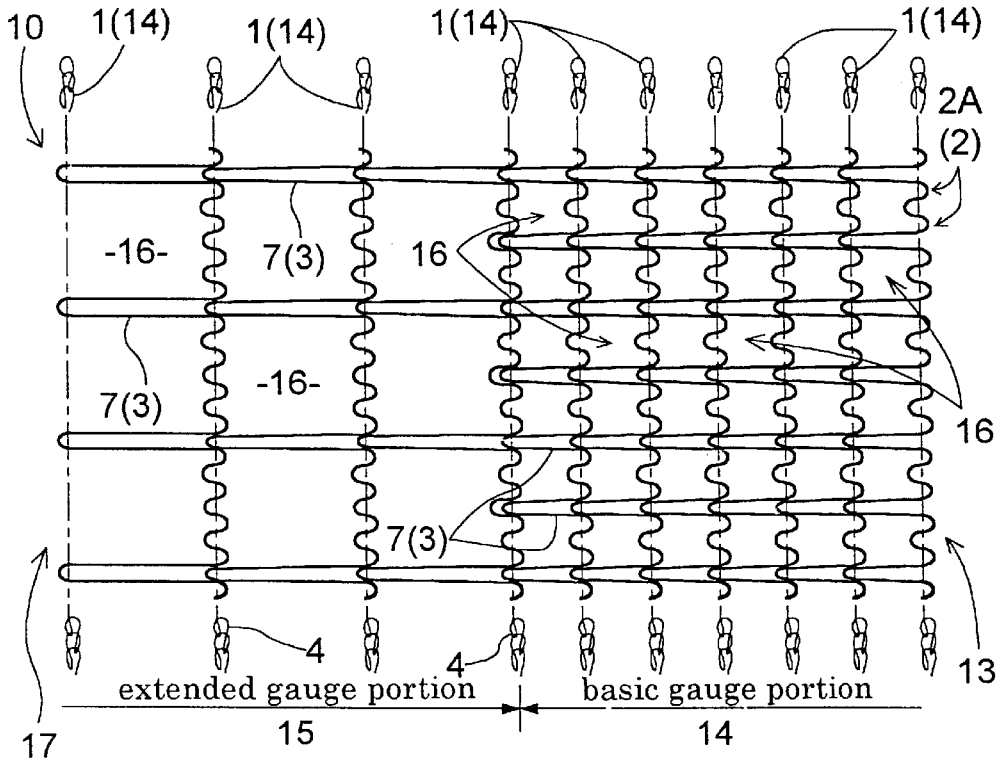
FIG. 1 is a view showing a knitting construction of principal portion of a lace knit according to one embodiment.

Referring to a ground weave of a lace knit 10 relating to the invention, as shown in FIG. 1, this ground weave includes a basic-gauge portion knitted according to a basic gauge (e.g., by setting 24 (twenty four) warp yarns 24 per inch (25.4 mm) on a knitting machine; referred to as "24 gauge" hereinafter) and an extended-gauge portion knitted according to an extended gauge (e.g. setting 12 (twelve) warp yarns per inch (25.4 mm) on the knitting machine; referred to as "12 gauge" hereinafter).

Figure 8:
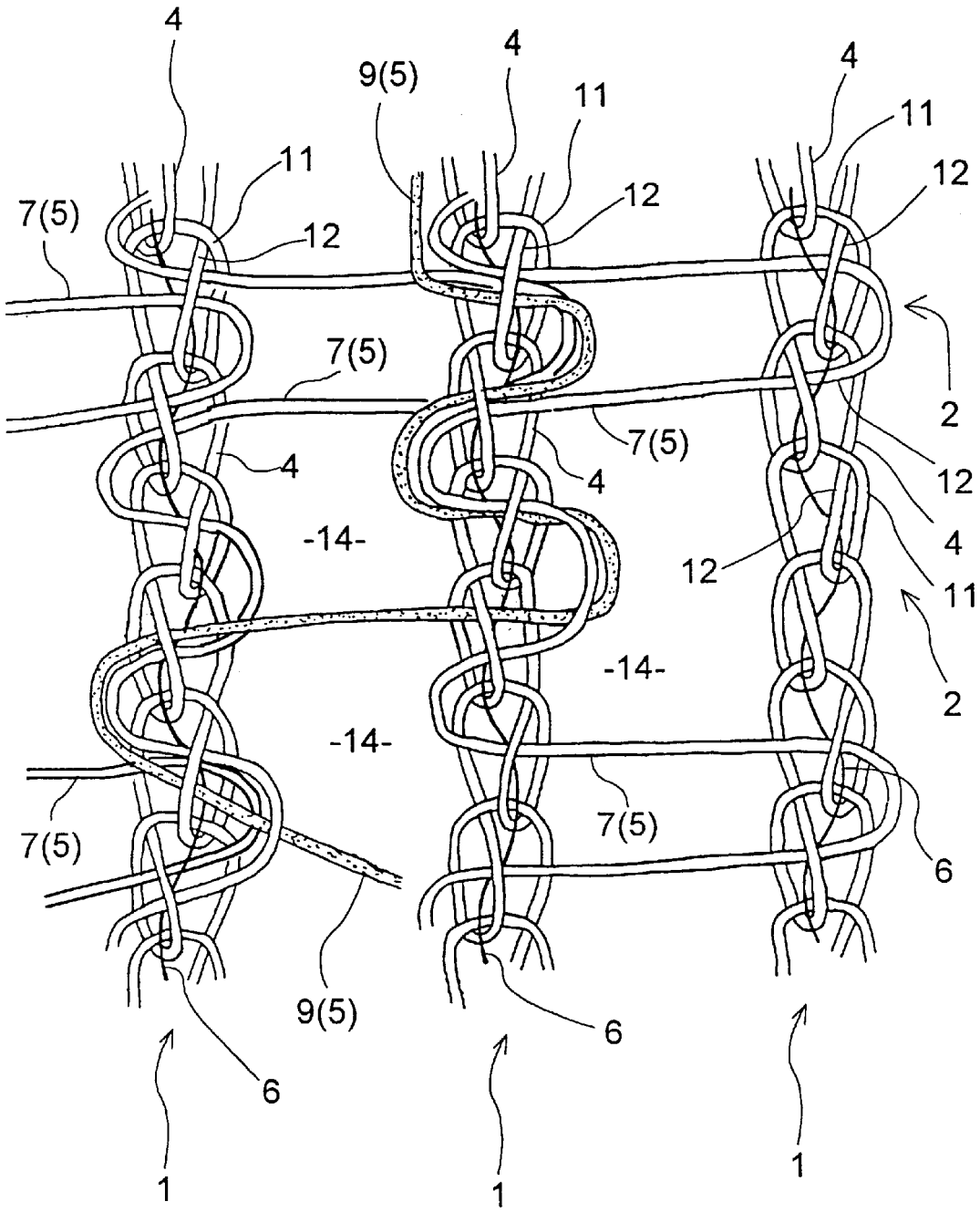
FIG. 8 is a construction view showing principal portions of a knitted construction of a conventional lace knit.
Figure 9:
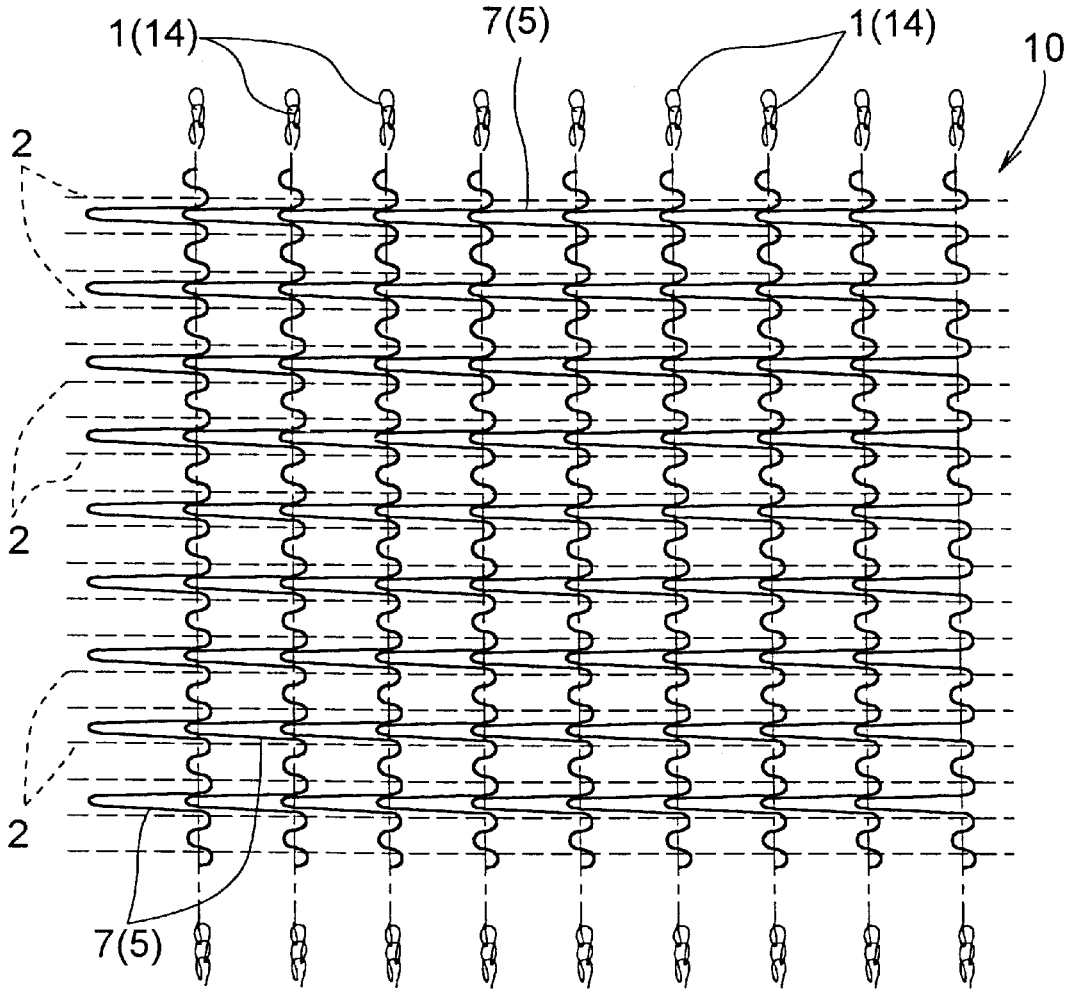
FIG. 9 is a schematic showing a ground weave of the conventional lace knit.
Figure 10:
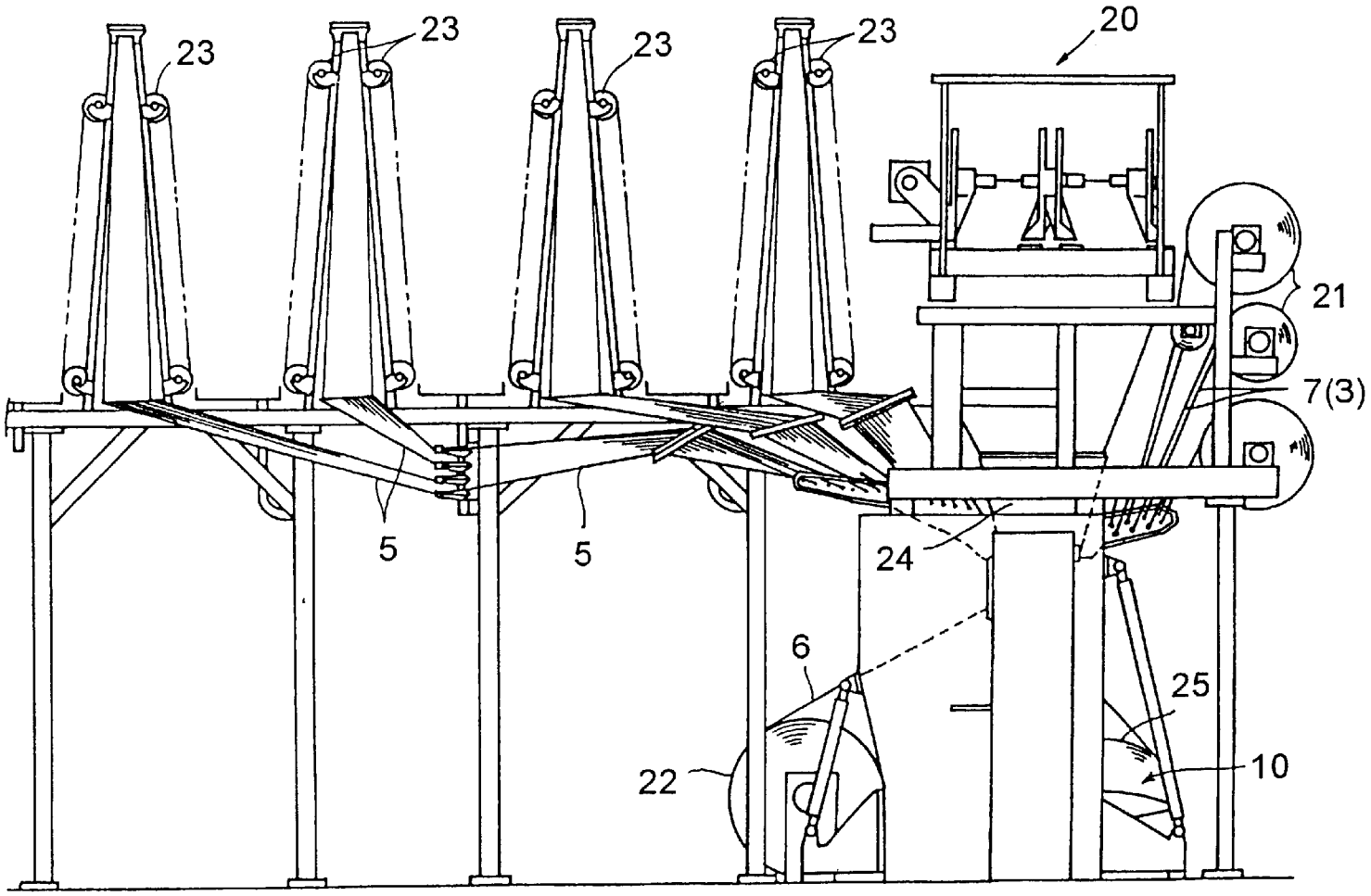
FIG. 10 is a side view of a conventionally employed lace knitting machine.
Figure 11:
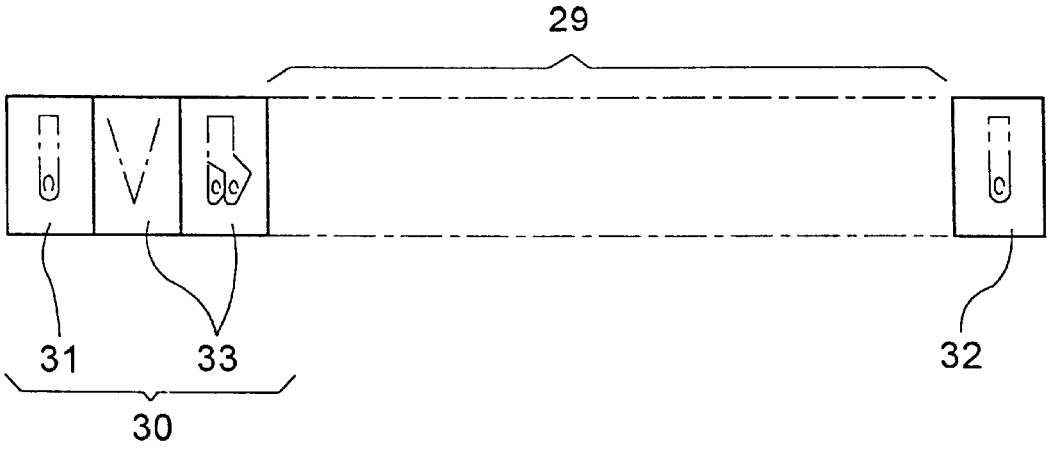
FIG. 11 is a view illustrating conventional usage and arrangement of a plurality of guide blocks in a knitting machine.
Figure 12:
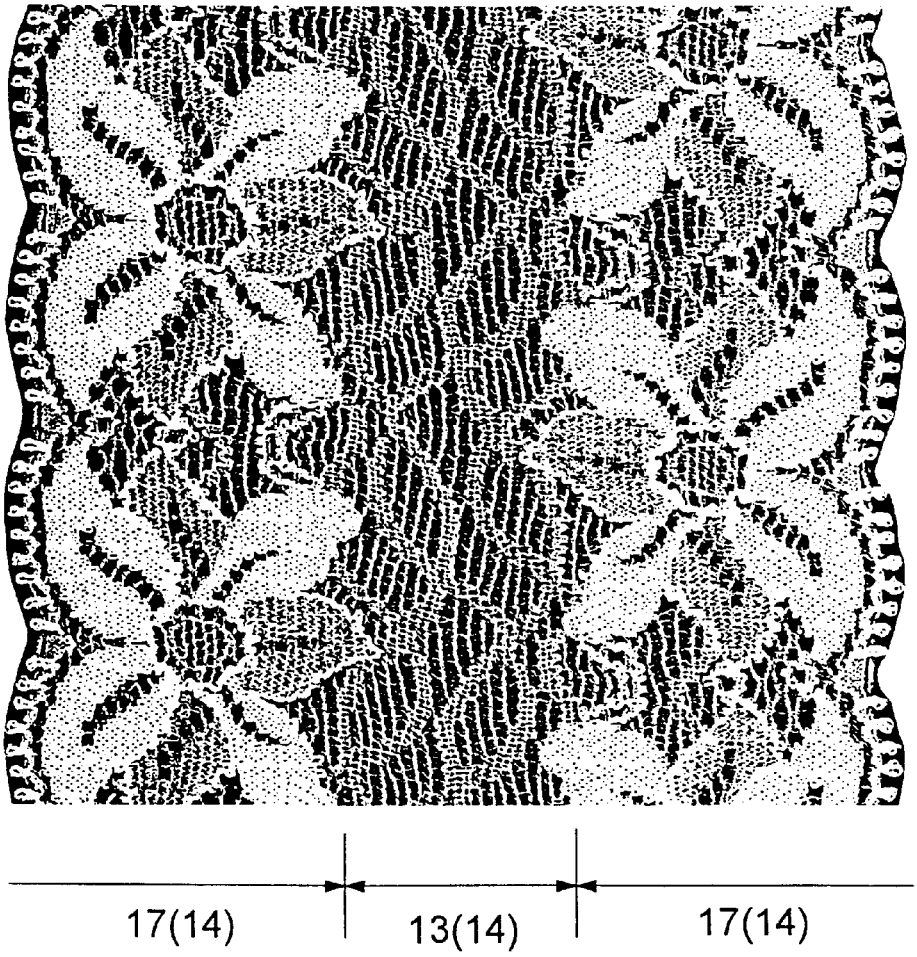
FIG. 12 is a view illustrating a knitted condition of the conventional lace knit.

More particularly, the lace knit 10 includes a plurality of wales 1 formed in the vertical direction by chain-stitched warps 4, a plurality of courses 2 formed continuously in the vertical direction by loops of warps 4 disposed side by side in the lateral direction, and a plurality of sinker loops 12 formed in needle loops 11 of the wales 1 so as to form the ground weave in the form of a net allowing insertion of a plurality of insertion yarns such as weft yarns and/or pattern-forming yarns therein (see FIG. 8).

Figure 2:
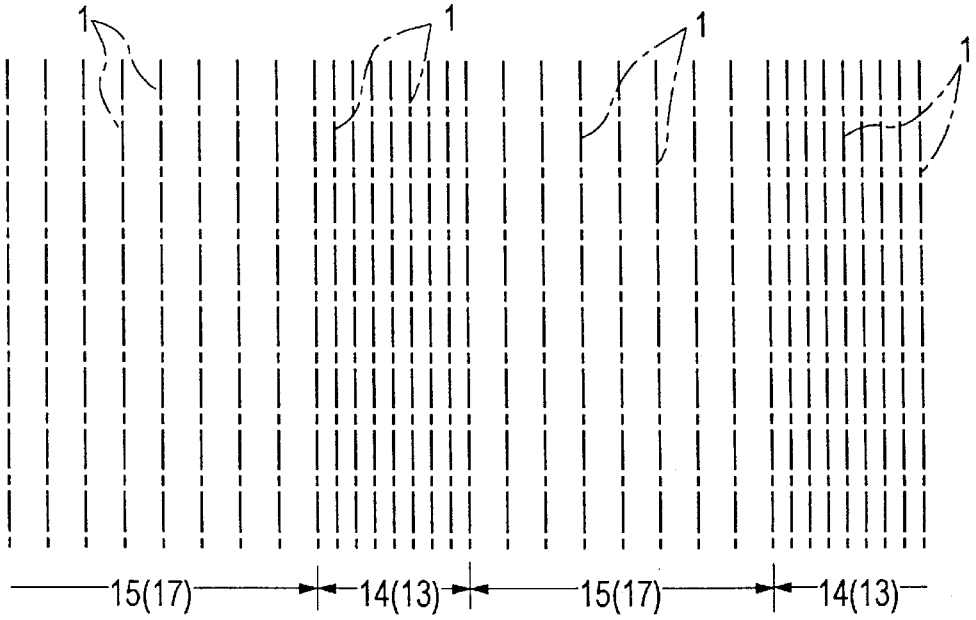
FIG. 2 is a schematic construction view of principal portion illustrating the ground weave of the lace knit shown in FIG. 1.

In FIG. 1, the wales 1 formed by the warp yarns 4 are schematically shown with dashed lines. And, as shown in FIG. 2, at least a portion of the ground weave is formed as the extended-gauge portion 15 knitted under the extended gauge sparser than the basic gauge of the basic-gauge portion 14 (in FIG. 2, only the wales 1 of the construction are shown with the dashed lines for the purpose of clarity). In the lace knit, the basic-gauge weave portions 14 and the extended-gauge portions 15 are formed alternately in the knitting width direction. In this manner, the basic-gauge portion 14 is provided as a net portion 13 in which the ground weave shows over a relatively large area on its surface, whereas the extended-gauge portion 15 is provided as an ornamental pattern portion 17 in which the ground weave shows over a relative small area while pattern-forming yarns show over a relatively large area on the surface thereof.

As described above, in the extended-gauge portion 15, the inter-wale distance between the adjacent wales 1 therein is greater than that in the basic-gauge portion 14. Hence, the extended-gauge portion 15 allows insertion of insertion yarns (substantially correspond to weft yarns 7 for this extended-gauge portion 5) which are thicker (single yarns of about 145 tex (1300 denier) for the lace knit 10 knitted under the 24 gauge) than 'basic' insertion yarns, e.g. weft yarns 7 to be inserted mainly into the basic-gauge portion 14. With use of such thick yarns, the extended-gauge portion 15 may be formed with increased thickness for forming the texture pattern. Also, if thick yarns as some of the insertion yarns 5 to be inserted into the extended-gauge portion 15 are pattern-forming yarns 9 which are thicker (e.g. yarns of 145 tex (1300 denier)) than the basic insertion yarns, then, the resultant lace knit 10 will provide more massive or voluminous ornamental pattern than the conventional lace knit.

For example, if twisted yarns of 178 tex (1600 denier) are employed as the pattern-forming yarns 9, these pattern-forming yarns themselves will 'float' proud on the surface of the lace knit, providing the ornamental pattern of the knit. The specific thickness of the pattern-forming yarn 9 is not limited to the above-mentioned values, but may be, for example 278 tex (2500 denier). With such thickness, the floating of the pattern-forming yarns 9 will become even more conspicuous, so that these pattern-forming yarns 9 will create a floating ornamental pattern by their own lines on the surface of the lace knit.

Figure 3:
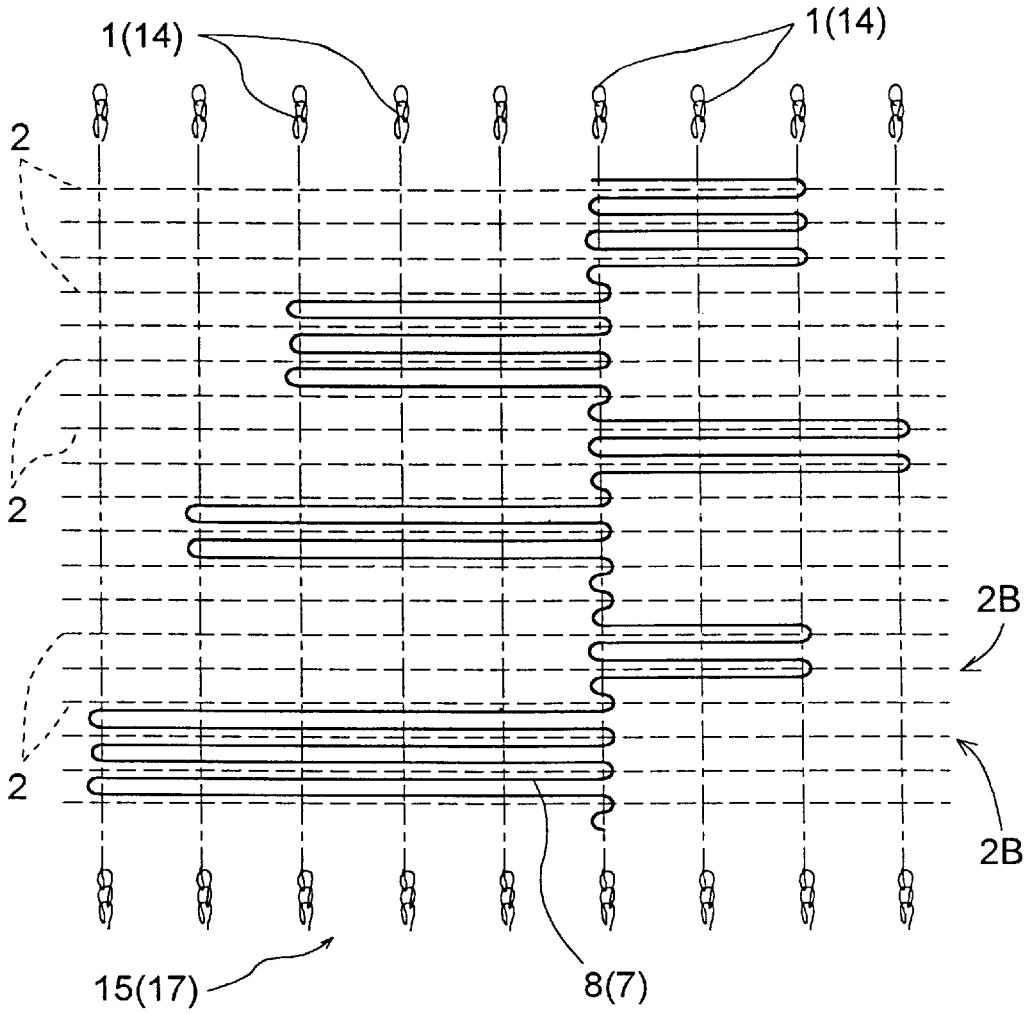
FIG. 3 is a construction view of principal portion showing a further ground weave of the lace knit relating to the invention.

Further, as shown in FIG. 3, some of the insertion yarns, for example, weft yarns 7 forming the ground weave of the extended-gauge portion 15 can be 'squeezer' yarns 8, so that in knitting the ground weave, these squeezer yarns 8 will be traversed by a greater traversing amount in certain predetermined courses 2B relative to basic courses (see FIG. 1) formed with a basic traversing amount.

By increasing knitting tension applied to the squeezer yarns 8 so as to squeeze the spaces or gaps between the wales (i.e. the inter-wale distance) knitted with these squeezer yarns 8, the pattern-forming yarns 9 (not shown) knitted over these squeezer yarns 8 will be caused to float to provide increased thickness for the ornamental pattern, thereby to achieve a texture simulating that of the so-called leaver lace.

FIG. 3 shows only the squeezer yarns 8, with the warp yarns 4, i.e., the wales 1 being denoted with dashed lines, the courses 2 including the weft yarns 7 being denoted with broken lines, respectively therein. Then, by providing a tension adjusting mechanism in the mechanism for feeding the squeezer yarns 8 and adjusting the tension to these yarns 8, the resultant ornamental pattern portion 17 will obtain increased thickness and even more conspicuous floating of the pattern-forming yarns 9 therein. The tension adjusting mechanism can be a feeding adjusting mechanism for the squeezer yarns 8.

As described above, the knitting tension of the squeezer yarns 8 can be adjusted by a mechanism for increasing the tension to these, yarns 8. Incidentally, it is also possible to adjust not only the knitting tension of the squeezer yarns 8 but also that or those of other insertion yarns (e.g. weft yarns 7) to be inserted into the extended-gauge portion 15. Further alternatively, it is possible to adjust only the knitting tension of the weft yarns 7 to be inserted into the extended-gauge portion 15. With this, it becomes possible to cause floating of all of the pattern-forming yarns 9 inserted into the extended-gauge portion 15.

Next, a method of knitting the above-described lace knit 10 by a lace knitting machine will be described.

In order to knit the basic-gauge portions and the extended-gauge portions continuously in knitting width direction as illustrated in FIG. 2 and described above, the knitting machine includes a needle bed which includes basic-gauge needle bed sections in which needles are arranged under the basic gauge (e.g., 24 gauge) and extended-gauge needle bed sections in which needles are arranged under the extended-gauge (e.g., 12 gauge) alternately and adjacent each other.

Figure 4:
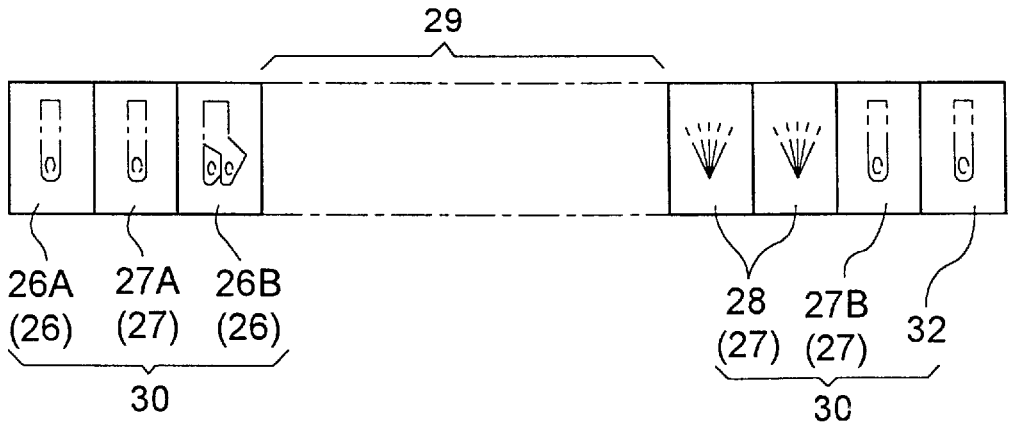
FIG. 4 is a view illustrating an arrangement of a plurality of guide blocks relating to an embodiment of a knitting method of the invention.

Whereas, the machine also includes a plurality of yarn guide blocks including a group of basic-gauge guide blocks 26 having guides thereof arranged under the basic gauge in correspondence to the basic-gauge needle bed sections and a group of extended-gauge guide blocks having guides thereof arranged under the extended-gauge needle bed sections or set to the extended-gauge by setting the yarns thereto under the extended gauge, in correspondence to the extended-gauge needle bed sections, thereby to knit the basic-gauge portions 14 (knitted under 24 gauge) and the extended-gauge portions 15 (knitted under 12 gauge) continuously. FIG. 4 shows an example of such allotment of guide blocks for the lace knitting machine.

Then, the resultant lace knit 10, as previously shown in FIG. 2, includes the basic-gauge portions 14 in the form of net including the wales with a normal or basic inter-distance and the extended-gauge portions 15 in the form of net including the wales with the extended or greater inter-distance, alternately and continuously in the knitting width direction.

FIG.4 shows a partial modification of the guide blocks and a jacquard mechanism for operating these guide blocks. Namely, the plurality of guide blocks are divided into the group of basic-gauge guide blocks 26 for knitting the basic-gauge portion 14 and the group of extended-gauge guide blocks 27 for knitting the extended-gauge portion 15.

The guides of the basic-gauge guide blocks 26 for hooking the yarns thereon are arranged under the basic gauge (24 gauge). Whereas, the guides of the extended-gauge guide blocks 27 are arranged under the extended-gauge (12 gauge).

And, in the ground-yarn guide block group 30, the forward-most guide block usually employed as a warp guide block (the guide block located on the left end in FIG. 4) (commonly referred to as L1) is used as a basic-gauge warp guide block 26A of the basic-gauge guide blocks 26 set under the basic gauge (24 gauge). The next guide block conventionally employed as a weft guide block (commonly referred to as L2 or L3) is used as an extended-gauge warp guide block 27A of the extended-gauge guide blocks 27 for forming the wales 1 of the extended-gauge portion 15. The subsequent guide block (commonly referred to as L4) is used as a basic-gauge weft guide block 26B of the basic-gauge guide blocks 26.

Further, the last guide block (commonly referred to as LE) in the group of the other insertion yarn guide blocks is used, like the convention,as an elastic yarn guide block 32 for knitting an elastic yarn 6 into the respective wales 1. The guides of the guide blocks corresponding to the basic-gauge needle bed section are set under the 24 gauge, while the guides of the guide blocks corresponding to the extended-gauge needle bed section are set under the 12 gauge.

And, among the guide blocks usually employed as the pattern-forming yarn guide blocks, the guide block disposed before the elastic yarn guide block 32 is modified to be employed as the extended-gauge weft guide block 27B of the extended-gauge guide blocks 27. That is to say, the basic-gauge warp block 26A and the extended-gauge warp guide block 27A together constitute the warp guide blocks, whereas the basic-gauge weft guide block 26B and the extended-gauge weft guide block 27B together constitute the weft guide blocks, respectively.

Further, the guides of the two guide blocks before the extended-gauge weft guide block 27B are set under the extended-gauge (12 gauge) to be used as a squeezer yarn guide block 28 of the extended-gauge yarn guide blocks 27. This squeezer warp guide block 28 is traversed by an amount (e.g., . . . 0-4/4-0/0-6/6-0/0-8/8-0. . . in terms of chain numbers) corresponding to the extended gauge which amount is greater than the basic traversing amount (e.g. to 0-2/2-0), so that this guide block is used as the guide block for knitting the squeezer yarn 8 into the ground weave.

With using this squeezer yarn guide block 28, the ground weave shown in FIG. 3 is made. By increasing the traversing amount of the squeezer yarn guide block 28, the distances or gaps between the wales are squeezed so as to provide a squeezing effect which causes the pattern-forming yarn 8 laid over the squeezer yarn 8 to float and which also increases the thickness of this portion. In this regard, if a beam (constituted from a portion of a pattern-forming yarn beam 23 (see FIG. 10)) is provided with a yarn-feed adjusting mechanism (not shown) for adjusting the feed rate of the squeezer yarn 8, which is one of the insertion yarns, within a predetermined range, a higher tension is applied to the squeezer yarn 8 compared with the other insertion yarns 6, especially the weft yarn 7, the above-described squeezing effect may be further enhanced.

In the case of the above construction, the ground-yarn guide block group 30 for this knitted weave includes the basic-gauge warp guide block 26A, the extended-gauge weft guide block 27A, the basic-gauge weft guide block 26B, the extended-gauge weft guide block 27B and the squeezer yarn guide block 28.

Figure 5:
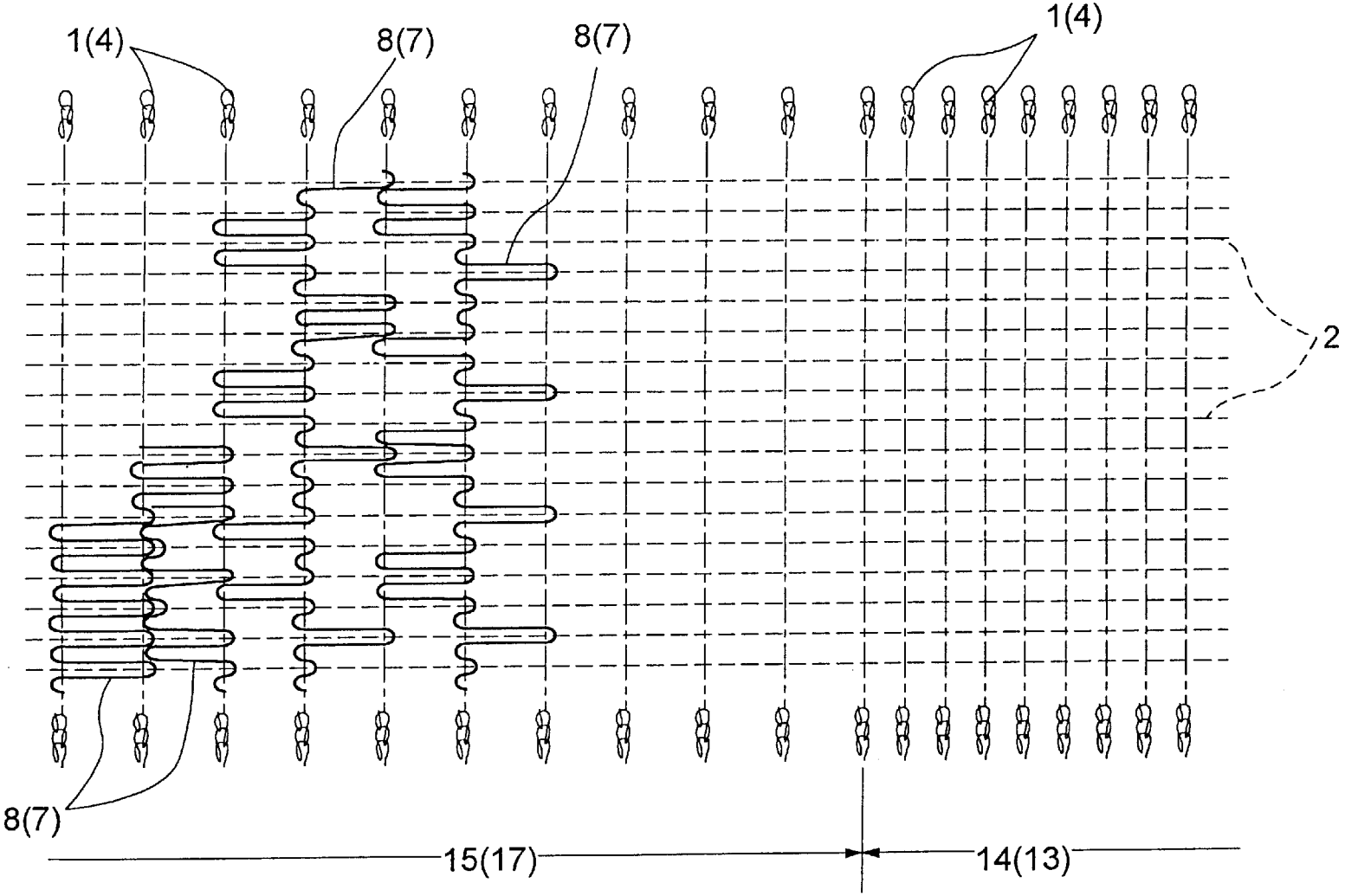
FIG. 5 is a construction view of principal portion showing a still further ground weave of the lace knit relating to the invention.

Incidentally, the traversing amount of the squeezer yarn guide block 28 is not limited to that for substantially knitting the ground weave shown in FIG. 3. The squeezer yarn 8 may be set freely according to the target pattern. This is because the pattern-forming yarn guide block 29 is employed as it is as the squeezer yarn guide block 28. For instance, as shown in FIG. 5, it is possible, of course, to traverse the squeezer yarn guide block 28 with the basic traversing amount in synchronism with the patter-forming yarn guide block 29 for knitting the pattern-forming yarn 9. Then, with application of additional knitting tension to the squeezer yarn 8, it is possible to provide the formed pattern with increased thickness or volume. In FIG. 5, the warp yarns 4, that is, the wales 1, are denoted with dashed lines, and the courses 2 and the weft yarns 7 are denoted with broken lines, respectively.

In forming the lace knit 10, it is a common practice to form unevenness at the edge of the pattern formed in the extended-gauge portion 15. To this end, it is possible to laterally offset the reference position for the traversing movement of the extended-gauge weft yarn guide block 27B for forming the extended-gauge portion 15 so as to align the end of the network of the extended-gauge portion 15 with the pattern edge.

Figure 6:
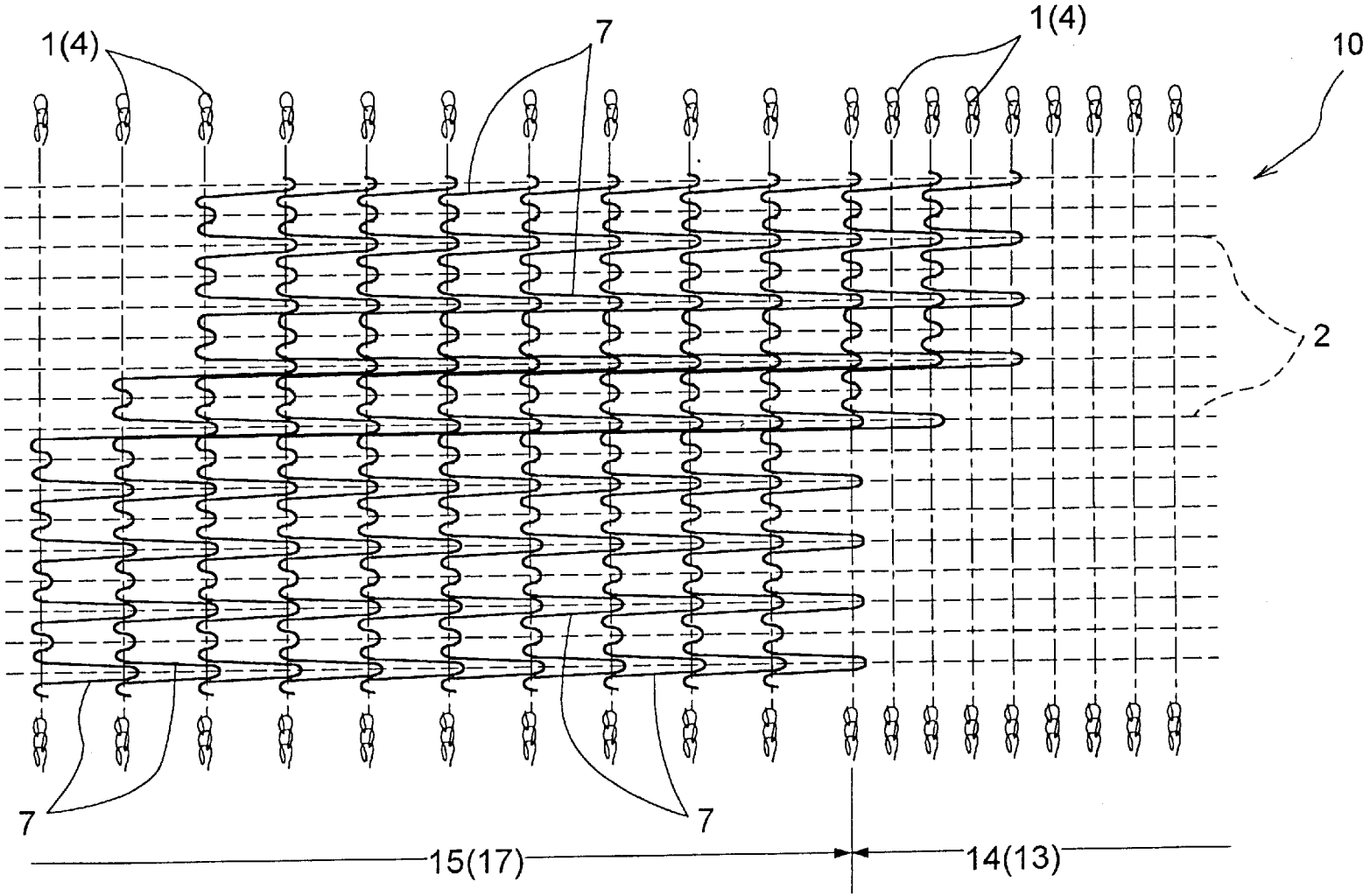
FIG. 6 is a construction view of principal portion showing a still further ground weave of the lace knit relating to the invention.

This is realized, as shown in FIG. 6 for example, by laterally traversing the extended-gauge weft yarn guide block 27B to displace the net in the lateral knitting direction. In this figure, the weft yarns of the basic-gauge portions 14 are not shown, the wales 1 are denoted with dashed lines, and the courses 2 are denoted with broken lines. For knitting such ground weave, the traversing movement of the extended-gauge weft yarn guide block 27B will be effected according to e.g., in terms of chain numbers, . . . /0-2/2-00-4/4-2/2-6/6-2/6-4/4-6/6-4. . . With this knitting, some of the extended-gauge portion weft yarns, which comprise a plurality of weft yarns 7, knitted under the extended-gauge in the extended-gauge portion 15 will be inter-knitted into the basic-gauge portion 14 at the predetermined courses.

This construction too is possible because the extended-gauge weft guide block 27B is constituted by one of the pattern-forming yarn guide blocks 29, with the possibility of free setting of its traversing amount. In this respect, because of the traversing movement, the weft yarns will not be engaged with some of the wales 1 at the predetermined courses. Such portions or gaps can be filled with the squeezer yarn 8, if necessary.

Figure 7:
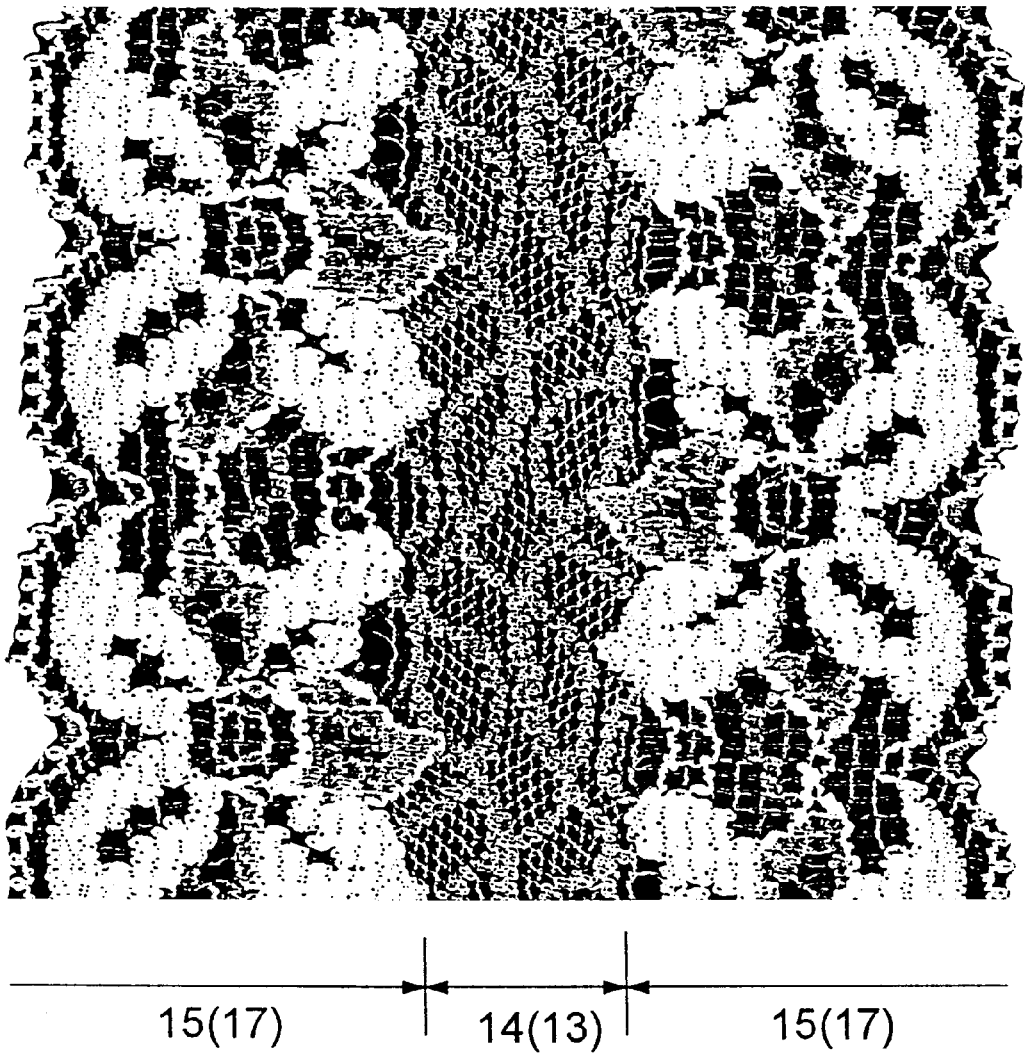
FIG. 7 is a view illustrating a knitted condition of the lace knit relating to the invention.

The lace knit knitted in the manner described above, such as the lace knit shown in FIG. 7, provides a massive and voluminous appearance with the floating ornamental pattern portion 17 formed with thick pattern-forming yarns 9.

[other embodiments]

Other embodiments of the lace knit and its knitting method relating to the invention will be described next.

<1>In the foregoing embodiment, the basic gauge is 24 gauge and the extended-gauge is 12 gauge, respectively. However, the setting of gauge is not particularly limited in this invention. For instance, the basic gauge may be 12 or 32 gauge.

The extended-gauge also can be freely set. It is not limited to the half of the basic gauge. For example, if the basic gauge is 24, the extended-gauge can be 18. While certain gauges are physically impossible, any combination of gauges except them can be employed. For example, the combination of the basic gauge and the extended gauge can be any combination represented by a ratio between natural numbers greater than 2, such as 24-12, 32-12, 36-12, 36-18, etc.

<2>In the foregoing embodiment, the ornamental holes 16 in the extended-gauge portion 15 are elongated relate to the holes 16 in the basic-gauge portion 14, as shown in FIG. 1. The particular size of arrangement of these ornamental holes 16 are not limited in the present invention.

<3>In the foregoing embodiment, the lace knit 10 including the basic-gauge portions 14 and the extended-gauge portions 15 formed alternately in the knitting width direction was explained with reference to FIG. 2. Instead, the lace knit may include a single basic-gauge portion 14 and a single extended-gauge portion 15 formed continuously.

<4>In the foregoing embodiment, the basic-gauge portion 14 comprises the net portion 13 forming the ground weave and the extended-gauge portion 15 comprises the pattern-forming portion 17 which basically includes the pattern-forming yarn. Although it is aesthetically preferred that the pattern-forming portion 17 be provided in the extended-gauge portion 15, the pattern-forming yarn 9 may be provided in the net portion 13 of the basic-gauge portion 14. In this manner, the specific arrangement of the pattern is not particularly limited in this invention.

<5>In the foregoing embodiment, the basic insertion yarn comprises the weft yarn 7 to be knitted into the net portion 13 of the basic-gauge portion 14 and this yarn has the thickness of about 78 tex. Instead, the yarn for forming the sinker loops can be the warp yarn 4 of the adjacent wale. In such case, no weft yarns are needed. Instead, the warp yarns will be traversed in the knitting width direction. And, the weft yarn can be thinner or thicker than the above value. The same applies to the extended-gauge portion.

The discussion of the foregoing embodiment indicates that the extended-gauge portion 15 allows insertion of a thick insertion yarn 5 as the result of its extended inter-wale distance. This is not to be construed to limit the specific thickness of the insertion yarn 5.

<6>In the foregoing embodiment, it was explained that one or some of the weft yarns 7 forming the ground weave of the extended-gauge portion can be the squeezer yarn(s) for forming the ground weave. However, the squeezer yarn 8 is not essential for the present invention. Namely, the lace knit 10 can include only the warp yarns 4, weft yarns 7 and the pattern-forming yarns 9. Further, as described hereinbefore, when the squeezer yarn 8 is employed, adjustment of its feeding can provide more distinguished effect. However, without such adjustment of yarn feeding, the effect using the squeezer yarn can be realized also by tension which is applied naturally when the yarn is fed.

<7>In the foregoing embodiment, the basic-gauge warp guide block 26A and the extended-gauge warp guide block 27A are provided separately. Instead, as the warp guide block 31, only the basic-gauge warp guide block 26A, which is a basic-gauge guide block 26, can be used. In this case, at the corresponding position in the extended-gauge needle bed section, the guides can be used under the extended-gauge alone. Further, if the guides are present at all of the positions corresponding to the needles of the extended-gauge needle bed section, the warp yarns for forming the extended-gauge portion can be set to only those guides corresponding to the needles.

<8>In the foregoing embodiment, in the extended-gauge yarn guide block 27, its guides are arranged under the extended gauge. Instead, the knitting can be effected with setting the weft yarns 7 or squeezer yarns 8 only to those guides at the positions corresponding to the extended gauge.

<9>Instead of the yarn guide block arrangement described above in the foregoing embodiment, regarding the pattern-forming yarn guide blocks 29, the extended-gauge weft guide block 27B can be disposed at the last position, the group of guide blocks before it can be replaced by elastic yarn guide blocks 32, and the group of guide blocks before them can be the extended-gauge weft guide blocks 27B for the special purpose, so that these special-purpose extended-gauge weft guide blocks 27B can function as squeezer yarn guide blocks 28. Any other yarn guide block can be employed as the squeezer yarn guide block 28.

<10>The insertion yarns 5 to be knitted into the lace knit are not limited to the ordinary twisted yarns. They can be slit yarns, cord yarns, braids, covering yarns, etc. Their material can be any natural or chemical fibers. The natural fibers include, but not limited to, cotton, hemp, animal hair, such as wool, silk, asbestos, etc. The chemical fibers include, but not limited to, rayon, cupra, acetate, triacetate, nylon, polyester, vinylon, Saran, acrylic fiber, polypropylene, spandex fiber, etc. Further, fibers of metal, glass, carbon, rocks, too can be employed.

The present invention may be embodied in any other forms than described above. The present embodiments, therefore, should be construed to illustrative, not limiting. Other modifications and changes will be apparent for those skilled in the art. And, such modifications and changes too are intended to be encompassed within the appended claims.

What is claimed is:

1. A lace knit comprising a plurality of wales formed in a vertical direction of the lace knit by chain-stitched warp yarns; a plurality of courses formed continuously by needle loops of the warp yarns disposed in a lateral direction of the lace knit; and a plurality of sinker loops formed in the needle loops of the wales so as to form a ground weave in the form of a net allowing insertion of insertion yarns such as weft yarns and/or pattern-forming yarns therein;

wherein the ground weave includes a basic-gauge portion knitted under a basic gauge and an extended-gauge portion knitted under an extended-gauge sparser than the basic gauge.

2. The lace knit according to claim 1, wherein the basic-gauge portion at least partially includes ornamental holes.

3. The lace knit according to claim 1, wherein the extended-gauge portion includes, as the insertion yarns, a group of extended-gauge weft yarns knitted under the extended gauge, and some of these extended-gauge weft yarns are inter-knitted in the basic-gauge portion at certain predetermined courses.

4. The lace knit according to claim 2, wherein the extended-gauge portion is formed as a pattern-forming portion having pattern-forming yarns therein.

5. The lace knit according to claim 1, wherein at least some of the insertion yarns to be knitted in the extended-gauge portion are thicker than basic insertion yarns which are knitted mainly in the basic-gauge portion.

6. A method of knitting a lace knit comprising the steps of:

providing the knitting machine with a needle bed which includes a basic-gauge needle bed section having needles thereof arranged according to a basic gauge and an extended-gauge needle bed section having needles thereof arranged according to an extended-gauge sparser than the basic gauge, with the basic-gauge needle bed section and the extended-gauge needle bed section being arranged adjacent each other; and correspondingly providing the knitting machine at least one basic-gauge guide block having guides thereof arranged according to the basic gauge and at least one extended-gauge guide block having guides thereof arranged according to the extended gauge or set to the extended gauge by setting yarns thereon according to the extended-gauge; and knitting a basic-gauge portion and an extended-gauge portion in series with using both the basic-gauge needle bed section and the extended-gauge needle bed section in combination as the needle bed and using both the basic-gauge guide block and the extended-gauge guide block in combination as the yarn guide, wherein the lace knit has a ground weave including a plurality of wales formed in a vertical direction of the lace knit by chain-stitched warp yarns, a plurality of courses formed continuously by needle loops of the warp yarns disposed in a lateral direction of the lace knit, and a plurality of sinker loops formed in the needle loops of the wales.

7. The method of knitting according to claim 6, wherein in forming the ground weave, weft yarns are inserted into the respective sinker loops formed in the needle loops of the wales;

a plurality of said basic-gauge guide blocks and a plurality of said extended-gauge guide blocks are provided;

in forming the basic-gauge portion, and at least one of the basic-gauge guide blocks is employed as a basic-gauge warp guide block, at least another of the basic-gauge guide blocks is employed as a basic-gauge weft guide block; and in forming the extended-gauge portion, at least another of the basic-gauge guide blocks or at least one of the extended-gauge guide blocks is employed as an extended-gauge warp guide block while at least another of the extended-gauge guide blocks is employed as an extended-gauge weft guide block.

8. The method of knitting according to claim 6, wherein at least some of the yarns set on the guides of the extended-gauge guide block are inter-knitted in the basic-gauge portion at certain predetermined courses.

9. The method of knitting according to claim 7, wherein the extended-gauge portion is knitted by traversing, in certain predetermined courses, the extended-gauge guide blocks by a greater traversing amount than a basic traversing amount for knitting the basic-gauge portion.

10. The method of knitting according to claim 6, wherein in knitting the insertion yarns into the extended-gauge portion, some of the insertion yarns are applied with a knitting tension greater than a knitting tension applied to the others.

11. The lace knit according to claim 3, wherein the extended-gauge portion is formed as a pattern-forming portion having pattern-forming yarns therein.

12. The knitting method according to claim 8, wherein the extended-gauge portion is knitted by traversing, in certain predetermined courses, the extended-gauge guide blocks by a greater traversing amount than a basic traversing amount for knitting the basic-gauge portion.

13. The lace knit according to claim 2, wherein the extended-gauge portion includes, as the insertion yarns, a group of extended-gauge weft yarns knitted under the extended gauge, and some of these extended-gauge weft yarns are inter-knitted in the basic-gauge portion at certain predetermined courses.

14. The lace knit according to claim 2, wherein at least some of the insertion yarns to be knitted in the extended-gauge portion are thicker than basic insertion yarns which are knitted mainly in the basic-gauge portion.

15. The method of knitting according to claim 7, wherein at least some of the yarns set on the guides of the extended-gauge guide block are inter-knitted in the basic-gauge portion at certain predetermined courses.

* * * * *

UNITED STATES PATENT AND TRADEMARK OFFICE

CERTIFICATE OF CORRECTION

PATENT NO. : 6,314,768 B2
APPLICATION NO. : 09/728559
DATED : November 13, 2001
INVENTOR(S) : Yasuhiko Motoya It is certified that error appears in the above-identified patent and that said Letters Patent is hereby corrected as shown below:

Title Page, [56] References Cited, U.S. PATENT DOCUMENTS, insert the following:
--4,197,725 4/1980 Kohl.....666/213--.

Title Page, [56] References Cited, insert the following:
--FOREIGN PATENT DOCUMENTS
1136439 11/1982 (CA)
0653507 5/1995 (EP)
2276412 1/1976 (FR)--.

Column 2 Line 2 “light-hand” should read --right-hand--.

Column 4 Line 5 “invention or,” should read --invention,--.

Column 10, Line 16 “. . . 0-4/” should read --. . . /0-4/--.

Column 12 Line 11 “portion” should read --portion 15--.

Signed and Sealed this

Twenty-fifth Day of March, 2008

JON W. DUDAS
*Director of the United States Patent and Trademark Office*